US007408843B2

(12) United States Patent
Brandon

(10) Patent No.: US 7,408,843 B2
(45) Date of Patent: Aug. 5, 2008

(54) MEDICINE CAP TIMING APPARATUS

(76) Inventor: Dennis Brandon, 114 Woodland Hills Dr., Brentwood, TN (US) 37027

( * ) Notice: Subject to any disclaimer, the term of this patent is extended or adjusted under 35 U.S.C. 154(b) by 0 days.

(21) Appl. No.: 11/457,631

(22) Filed: Jul. 14, 2006

(65) Prior Publication Data

US 2007/0014191 A1 Jan. 18, 2007

Related U.S. Application Data

(60) Provisional application No. 60/699,547, filed on Jul. 15, 2005.

(51) Int. Cl.

| | |
|---|---|
| ***G04B 47/00*** | (2006.01) |
| ***B65D 41/04*** | (2006.01) |
| ***B65D 53/00*** | (2006.01) |
| ***G07F 1/00*** | (2006.01) |
| ***B65B 59/00*** | (2006.01) |

(52) U.S. Cl. ..... 368/10; 215/329; 215/342; 221/2; 221/15

(58) Field of Classification Search ..... 368/10, 368/278; 206/528, 534; 215/201, 214, 217–223, 215/329–335, 341, 342–346
See application file for complete search history.

(56) References Cited

U.S. PATENT DOCUMENTS

| | | | | |
|---|---|---|---|---|
| 3,394,829 | A | 7/1968 | Peterson | |
| 4,367,955 | A * | 1/1983 | Ballew | 368/10 |
| 4,419,016 | A * | 12/1983 | Zoltan | 368/10 |
| 4,832,218 | A | 5/1989 | Gibilisco | |
| 5,016,230 | A * | 5/1991 | Seifers et al. | 368/10 |
| 5,233,571 | A * | 8/1993 | Wirtschafter | 368/10 |
| 5,313,439 | A | 5/1994 | Albeck | |
| 5,751,661 | A * | 5/1998 | Walters | 368/10 |
| 6,084,504 | A * | 7/2000 | Rosche et al. | 340/309.7 |
| 6,229,431 | B1 * | 5/2001 | Weiner | 340/309.7 |
| 6,259,794 | B1 * | 7/2001 | Dobbins | 381/124 |
| 6,317,390 | B1 * | 11/2001 | Cardoza | 368/10 |
| 6,324,123 | B1 * | 11/2001 | Durso | 368/10 |
| 6,424,599 | B1 * | 7/2002 | Ditzig | 368/10 |
| 6,545,592 | B2 * | 4/2003 | Weiner | 368/10 |
| 6,633,796 | B1 * | 10/2003 | Pool et al. | 700/231 |
| 6,667,036 | B2 * | 12/2003 | Cummings et al. | 424/153.1 |
| 6,710,703 | B2 * | 3/2004 | Huang | 340/309.16 |

(Continued)

OTHER PUBLICATIONS

International Search Report and Written Opinion of the International Searching Authority.

*Primary Examiner*—Vit W Miska
(74) *Attorney, Agent, or Firm*—W. Edward Ramage; Baker Donelson

(57) ABSTRACT

A medicine cap with a timing mechanism that automatically resets upon the removal of the cap from a medicine bottle. A timing device is housed within a medicine camp, with a diaphragm housed below the timing device. The diaphragm has a rod extending upward from a central location, and fastening the cap onto a bottle or container causes the rod to be pushed up into contact with, and activate, the timing device. Upon removal of the cap from the bottle or container, the rod loses contact with the timing device, and the timer is reset. The cap may comprise multiple pieces, so the cap may be used in child-proof mode by the engagement and disengagement of splines on the cap housing and a cap insert. Means are supplied for enabling the constant engaging of the splines.

23 Claims, 21 Drawing Sheets

U.S. PATENT DOCUMENTS 6,854,064 B2 * 2/2005 Ahn ..... 713/300
7,138,906 B2 11/2006 Rosche
2001/0040500 A1 * 11/2001 Weiner ..... 340/309.15
2005/0047114 A1 * 3/2005 Harrell et al. ..... 362/101
2006/0283831 A1 * 12/2006 Krueger ..... 215/349

* cited by examiner

MEDICINE CAP TIMING APPARATUS

This application claims benefit of U.S. patent application Ser. No. 60/699,547, filed Jul. 15, 2005, by Dennis Brandon, and is entitled to that filing date for priority. The specifications and drawings of the above application are incorporated herein by specific reference.

FIELD OF INVENTION

This invention relates generally to timers, and more particularly to medication timer mechanisms.

BACKGROUND OF INVENTION

The majority of medicines and drugs require administration in a series of doses at specific times over a period of time for increased effectiveness. Outside the hospital or clinic setting, this usually requires the patient or an individual caring for the patient to be responsible for keeping track of the taking of the medication in question. A frequent problem, however, is that the patent or individual keeping track often errs in the administration of the medication. Patients may forget to take a dose of their medication, be tardy in taking a dose, or forget taking a dose and take a second dose too soon.

A number of approaches to solving this problem are found in the prior art. There are a number of devices, for example, that comprise a pill case or box with a timer or alarm to alert the patient that a certain time period has passed and that medication should be taken. These devices, however, are not suitable for many types of medication that should not be transferred from their initial container, and also may lead to problems associated with mixed medications and accumulated toxicity. In addition, these simple alarms provide no means to ensure or check compliance with administration of the medication. Furthermore, if the patient does take the medication at the proper time, the patient may fail to reset the timer or alarm.

In response to these problems, a number of devices have been developed that incorporate the timing mechanism and alarm in the cap or lid of the medication bottle or container itself. Examples of such mechanisms are found in Wirtschafter (U.S. Pat. No. 5,233,571), Albeck (U.S. Pat. No. 5,313,439), and Walters (U.S. Pat. No. 5,751,661). Several problems still are found with these devices, however, including false resetting of the timer or alarm without the medicine cap ever being removed or the medicine taken, interruption of power to the timer, breach of the medication-containing compartment, interference with child-resistant mechanisms, and delicacy of the mechanisms leading to high failure rates. An additional problem is the high cost and complex assembly of many such devices, which prohibits their wide adoption and use.

Accordingly, what is needed is an automatic timing mechanism for a medicine cap that is reliable, stable, easy to assemble and operate, low in cost, and compatible with both child-resistant and non-child-resistant medication containers.

SUMMARY OF THE INVENTION

The present invention provides for a medicine cap with a timing mechanism that automatically resets upon the removal of the cap from a medicine bottle. In general, the present invention comprises means for calculating or measuring time with means for providing an alert when a particular time interval has elapsed.

In one exemplary embodiment, the timing means is a conventional solid state timing device mounted on a circuit board with one or more power sources, such as batteries. The circuit board is in contract with display means, such as an LED, mounted on a cap top insert component. The circuit board and cap top insert component are snap fit inside a cap exterior housing. A threaded insert component with a flexible diaphragm is snap fit below the circuit board, and a central rod on the diaphragm makes contact with the timing circuitry when the cap assembly is fastened onto a medicine bottle. Upon removal of the cap from the bottle, the central rod loses contact with the timing circuitry, and the timer is reset.

In another exemplary embodiment, the cap comprises a cap housing and a cap insert, each with matching splines that can be engaged and disengaged with the application of pressure so the cap may function in child-proof mode. Means are provided for causing the splines to be constantly engaged where child-proof mode is not desired.

DETAILED DESCRIPTION OF THE INVENTION

Various forms of the standard medication container comprising a container and a cap is well known in the art. The container may contain medication in various forms. The top portion of the container typically contains threads or other means capable of engaging and securing the cap to the container. The container may vary in size, structure and configuration as necessary for differing medications, and the cap similarly will vary in size, structure and configuration to accommodate the different styles of containers.

Figure 1:
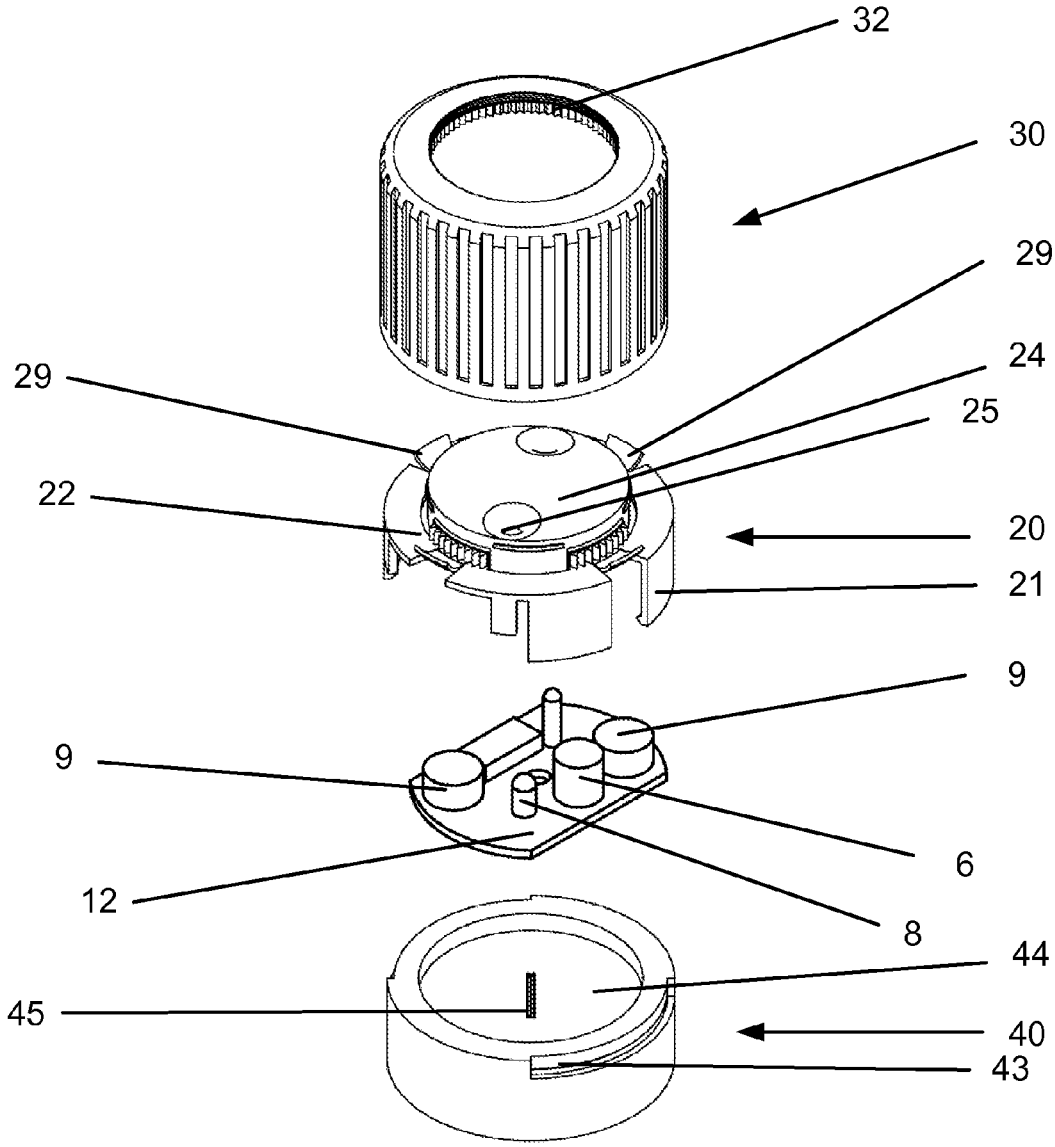
FIG. 1 shows an exploded perspective view of the major components of a cap timing mechanism in accordance with an embodiment of the present invention.

FIG. 1 illustrates an exploded view of an exemplary embodiment of a medication timing apparatus in a cap in accordance with the present invention. The cap comprises a timing device 6, preferably on a circuit board 12, placed on a threaded insert section 40 and covered at least in part with a cap top insert section 20, all of which is enclosed in a cap exterior housing 30.

As seen in FIGS. 2, 2*a*, 2*b*, 3 and 3*a*, the cap contains means for measuring time, said means preferably comprising a timer 6 or similar device that measures time by means of an oscillating crystal or similar device. The timer 6 may comprise various components, including digital or analog components, and may be integrated in a circuit. In a preferred exemplary embodiment, the timer 6 comprises a microprocessor chip or a chip-on-board. The invention includes means for supplying power, such as one or more batteries 9 electrically connected to the timer 6. In one embodiment of the present invention, removable tabs may be used in conjunction with the batteries to prevent power from being supplied to the timer 6. The tabs are removed by the pharmacist, patient or other end-user when the timing cap is first activated. In another embodiment of the invention, a minimal level of power is always being supplied, allowing the actual time and other data (such as the number of times the cap has been removed) to be set and stored in memory.

In one exemplary embodiment, the invention includes means for providing a visual alert, such as an LED display or light 8. In another exemplary embodiment, an alert can be provided by audible alert means. And in yet another exemplary embodiment, additional display means, such as an LCD display, can provide an alert message or other information, such as time elapsed or time remaining.

Figure 2:
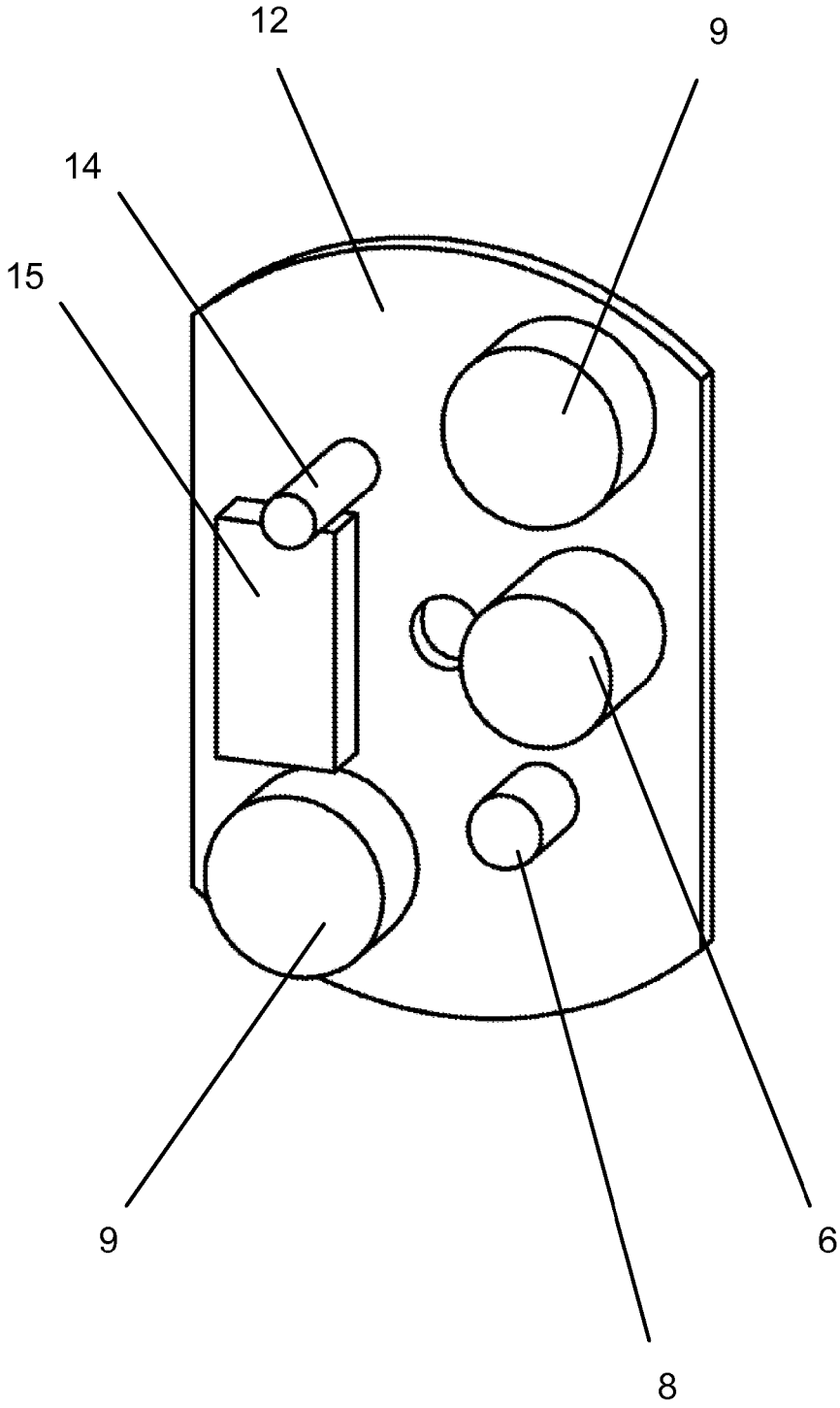
FIG. 2 shows a perspective view of a circuit board and timer in accordance with an embodiment of the present invention.
Figure 3:
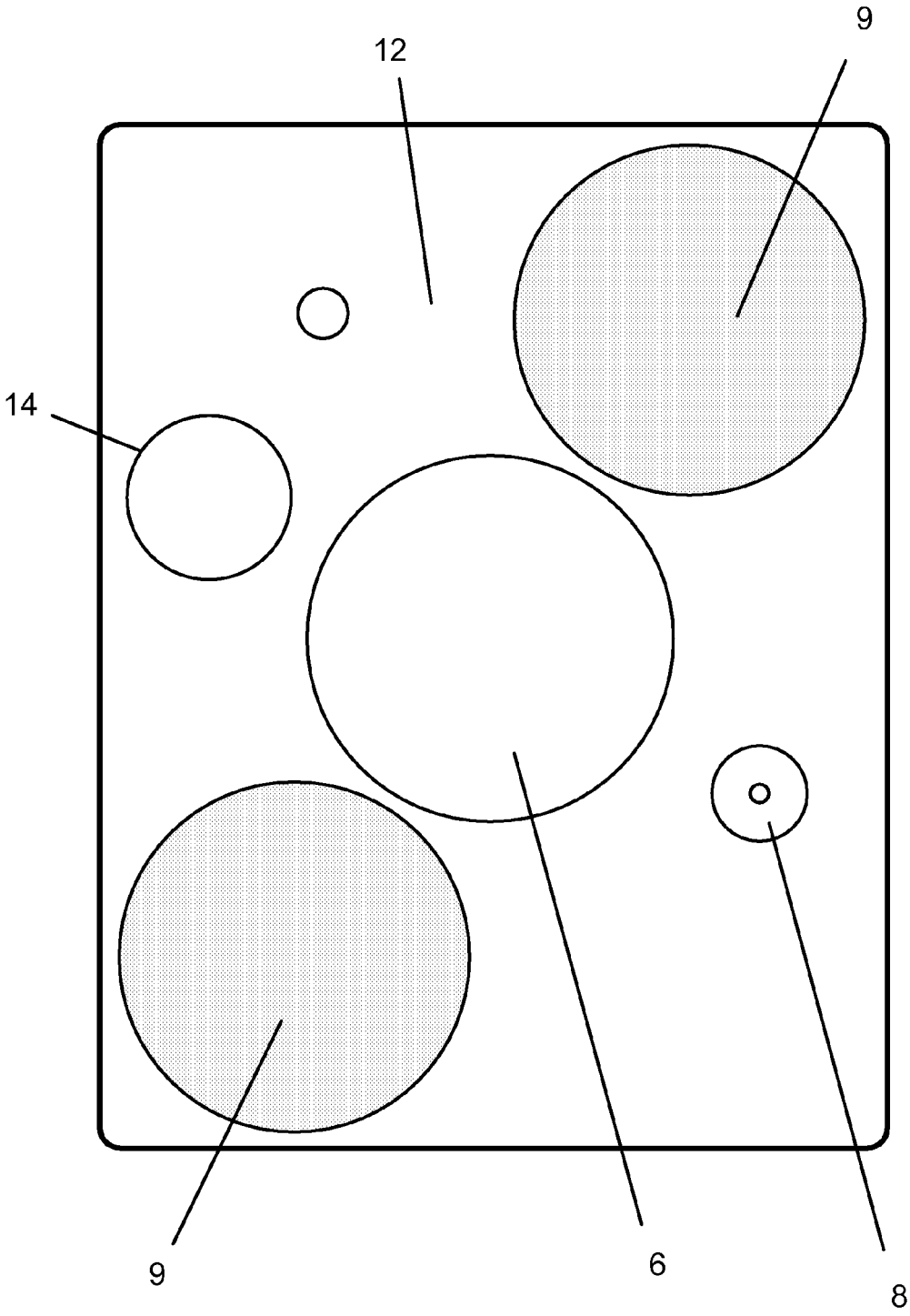
FIG. 3 shows a top view of the circuit board and timer of FIG. 2.

The timing components, including the batteries 9, preferably are mounted on a circuit board 12. The circuit board 12 is located underneath the cap top insert component 20, and is in electrical contact with the visual alert means, such as the LED display or light 8, or additional display means, which may alternatively be located in the cap top insert 20. In an exemplary embodiment, as shown in FIGS. 2 and 3, the LED display or light 8 may be mounted on the circuit board 12 and extend to or upward through a matching hole 25 in the cap top insert 20. Similarly, means for resetting the timer, such as a reset button or switch 14, may be mounted on the circuit board 12, with a matching hole 23 in the cap top insert providing access to the reset means 14, or to which the reset means 14 may extend to or upward through. In yet another exemplary embodiment, a reset button or switch may be located on the cap top insert 20, and be connected to the means for resetting the timer 14 located on the circuit board 12. In another exemplary embodiment, as seen in FIG. 2, the circuit board 12 has all primary circuit components located on one side (which may be called the "top side") of the board, although in other embodiments some components may be located on both sides. A hole 16 is located in or near the center of the circuit board 12 for purposes described below.

Figure 4:
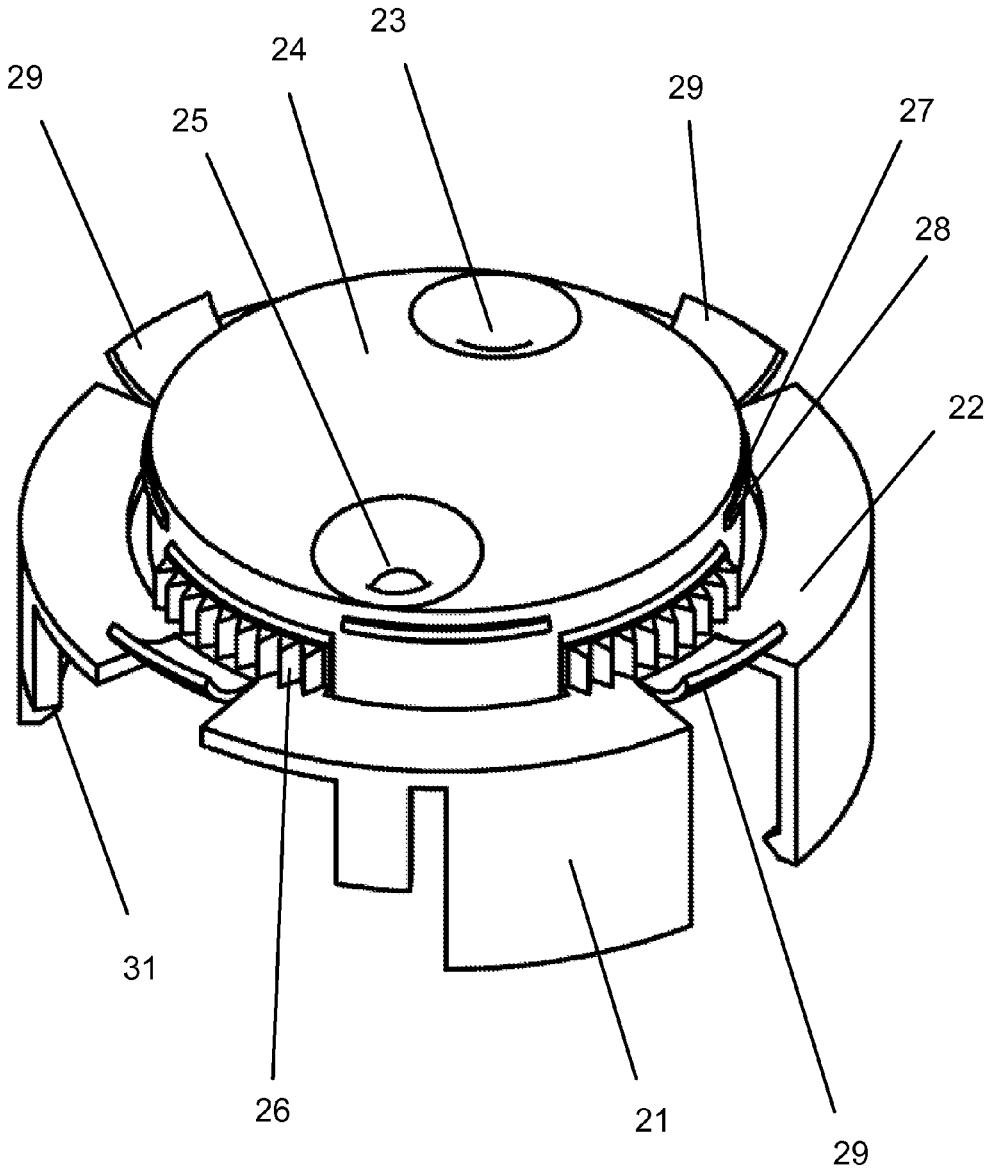
FIG. 4 shows a perspective view of a cap top insert section in accordance with an embodiment of the present invention.
Figure 18:
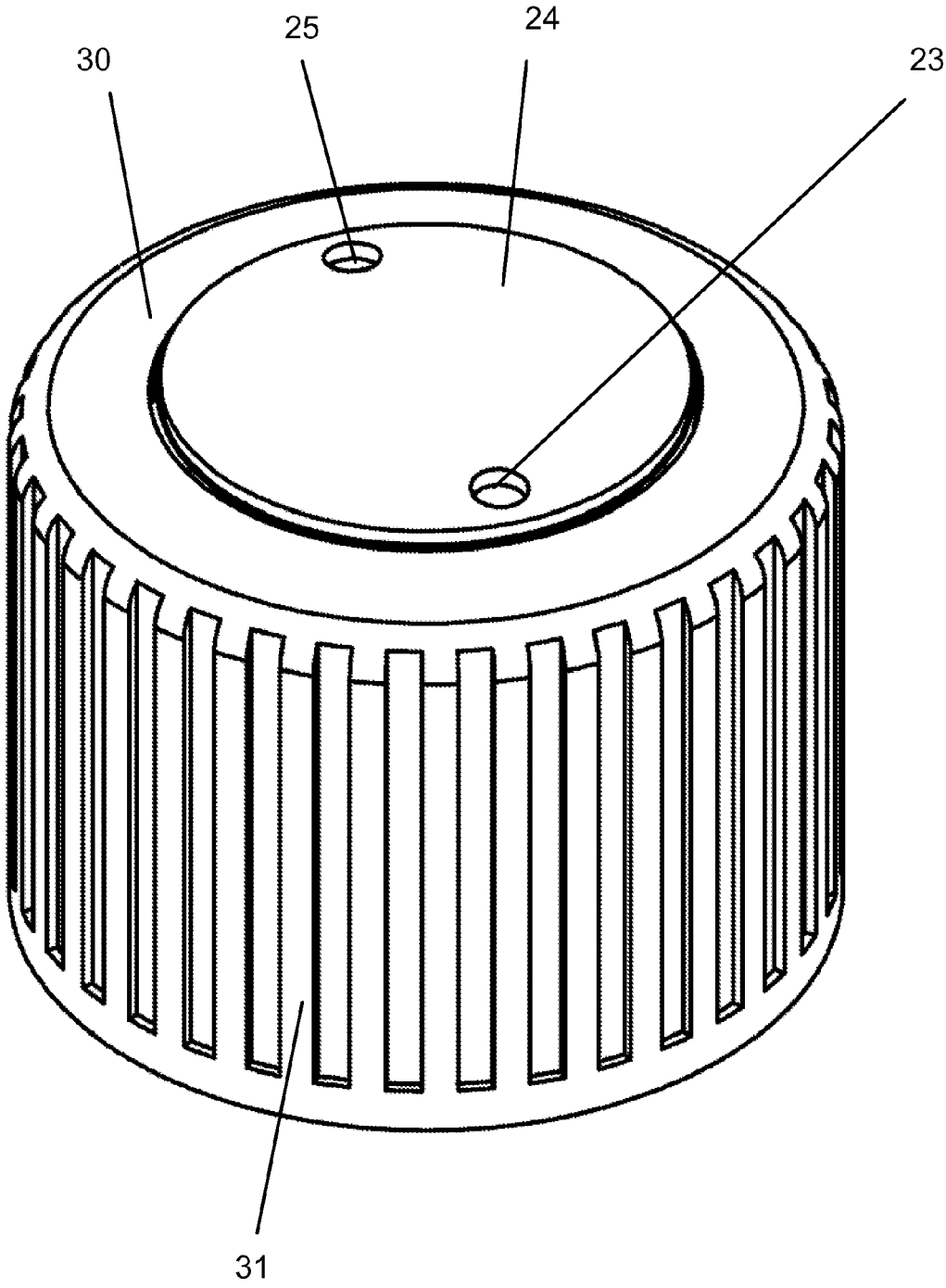
FIG. 18 shows a perspective view of an alternative configuration of the cap exterior housing and cap top insert in accordance with another embodiment of the present invention.

In a preferred embodiment, as seen in FIGS. 4 and 18, the cap top insert 20 comprises a flat circular outer disk section 22 with a raised central disk section 24. The raised central disk section 24 contains the holes for the LED display or light 25 and reset button or means 23. In an alternative embodiment, the central disk section 24 may contain the LED display or light itself, the reset button or means itself, or some combination of the above and holes.

A plurality of splines or tabs 26 are located around the circumference of the raised central disk section 24. These splines or tabs 26 may selectively engage matching splines or tabs 32 on the interior of the cap exterior housing 30 when the cap is operated. The number, size and configuration of the splines 26 may vary, and may only be located at certain sections around the circumference of the raised central disk section 24. The height of the splines 26 also may vary, and may extend to the height of the raised central disk section 24, or only partway up, as shown in FIG. 4. Other engaging means also may be used.

Figure 5:
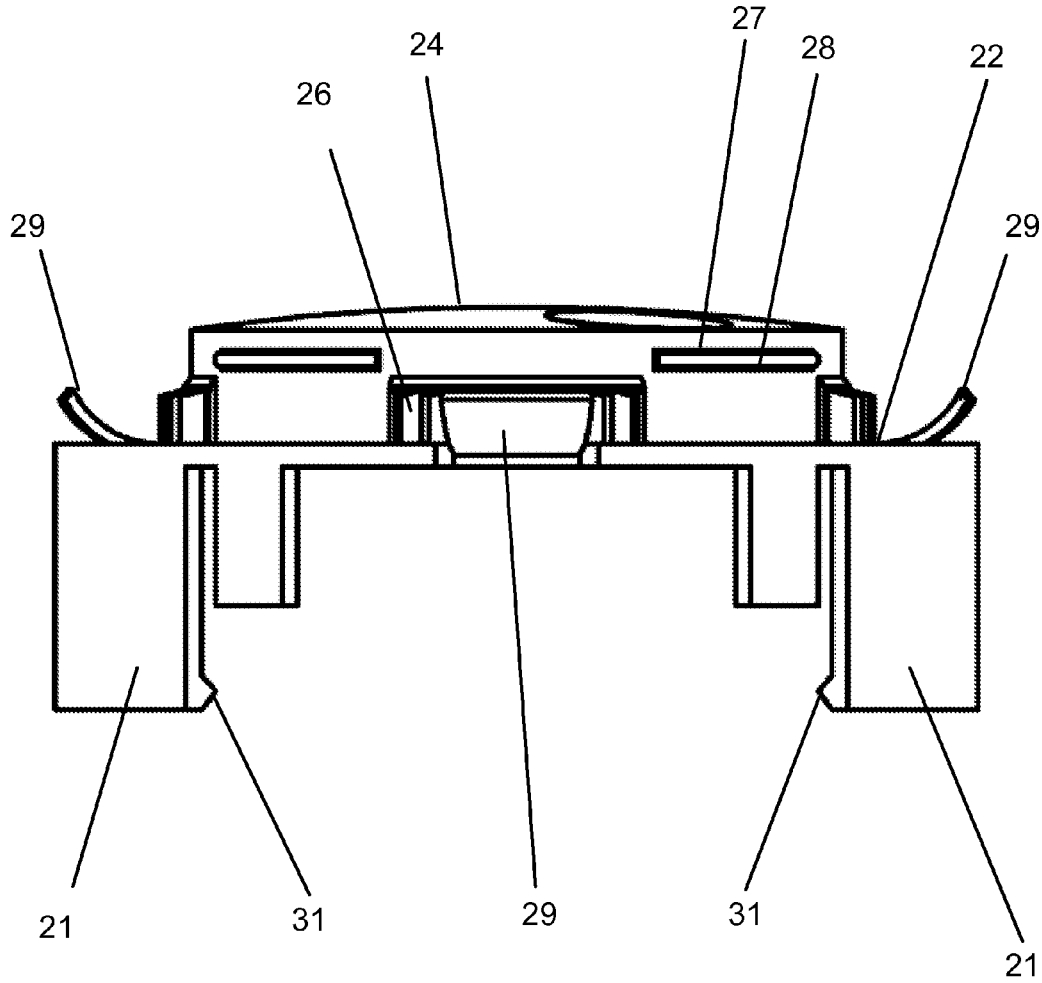
FIG. 5 shows a side view of the cap top insert of FIG. 4.
Figure 6:
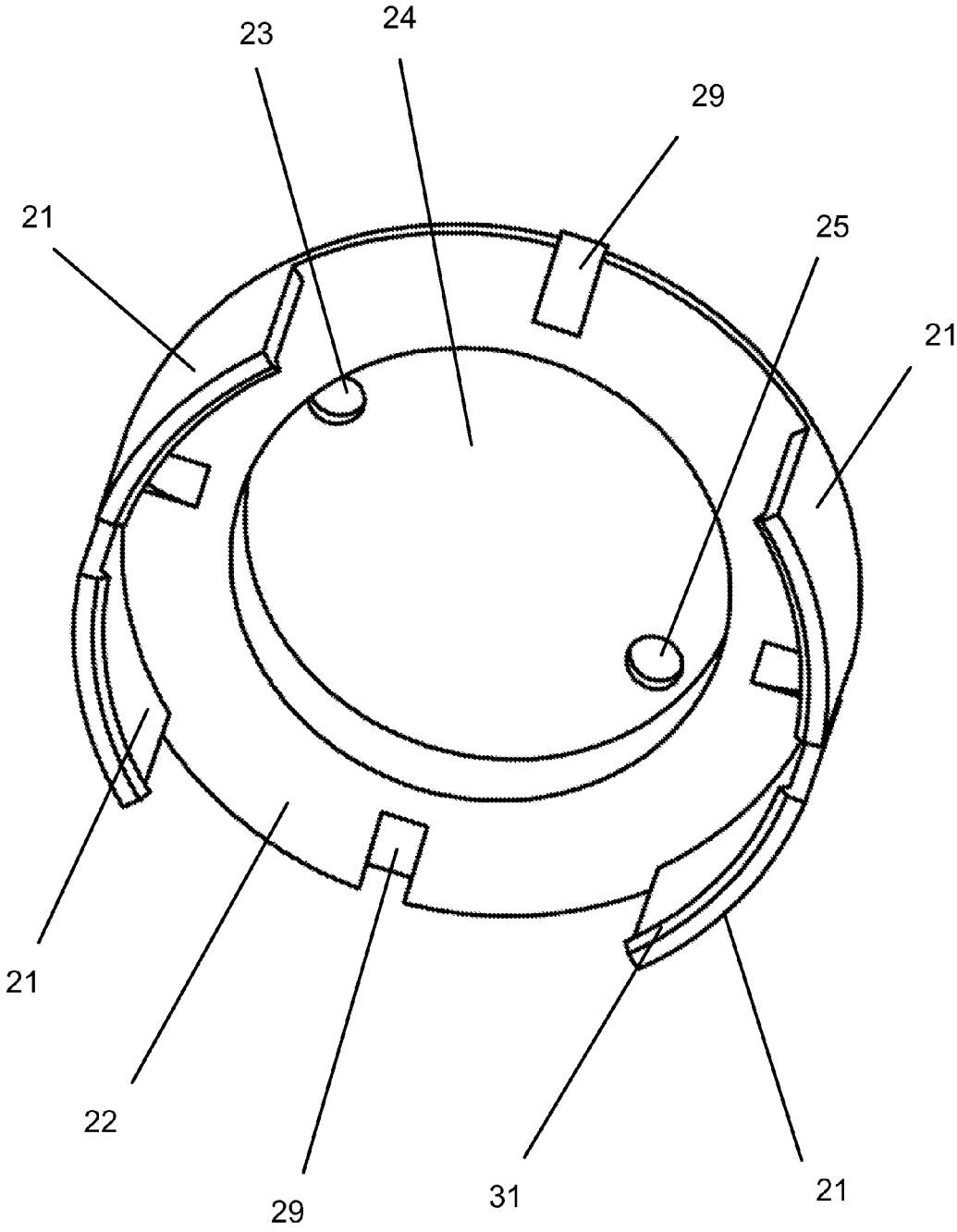
FIG. 6 shows a perspective view of the bottom of the cap top insert of FIG. 4.

In one exemplary embodiment, as shown in FIGS. 4, 5 and 6, the height of the splines 26 is lower than the height of the raised central disk section 24. A circumferential groove 27 may be located in the side of the raised central disk section above the top of the splines 26. A snap ring 28 or similar retaining ring or device may be placed around the raised central disk section to engage the circumferential groove 27 and hold the cap exterior housing 30 down so the splines 26 of the cap top insert 20 engage the matching splines 32 of the cap exterior housing 30. The snap ring 28 may be flat or round, and may come in several colors to draw attention to its presence. If the snap ring 28 is left on, the cap functions in non-childproof mode.

If the snap ring 28 is removed, the cap functions in childproof mode as the cap exterior housing 30 must be pressed down for the splines 26, 32 to engage. One or more spring tabs 29 are located on the top of the flat circular outer disk section 22 between the outer edge of the disk and the splines 26. The spring tabs 29 act to press the cap exterior housing 30 up and away from the cap top insert 20 a sufficient distance to disengage the splines 26, 32 and with sufficient force so that a child should not be able to cause the splines to engage. The spring tabs 29 may be molded as integral parts of the cap top insert 20, or may be mounted thereon.

Figure 7:
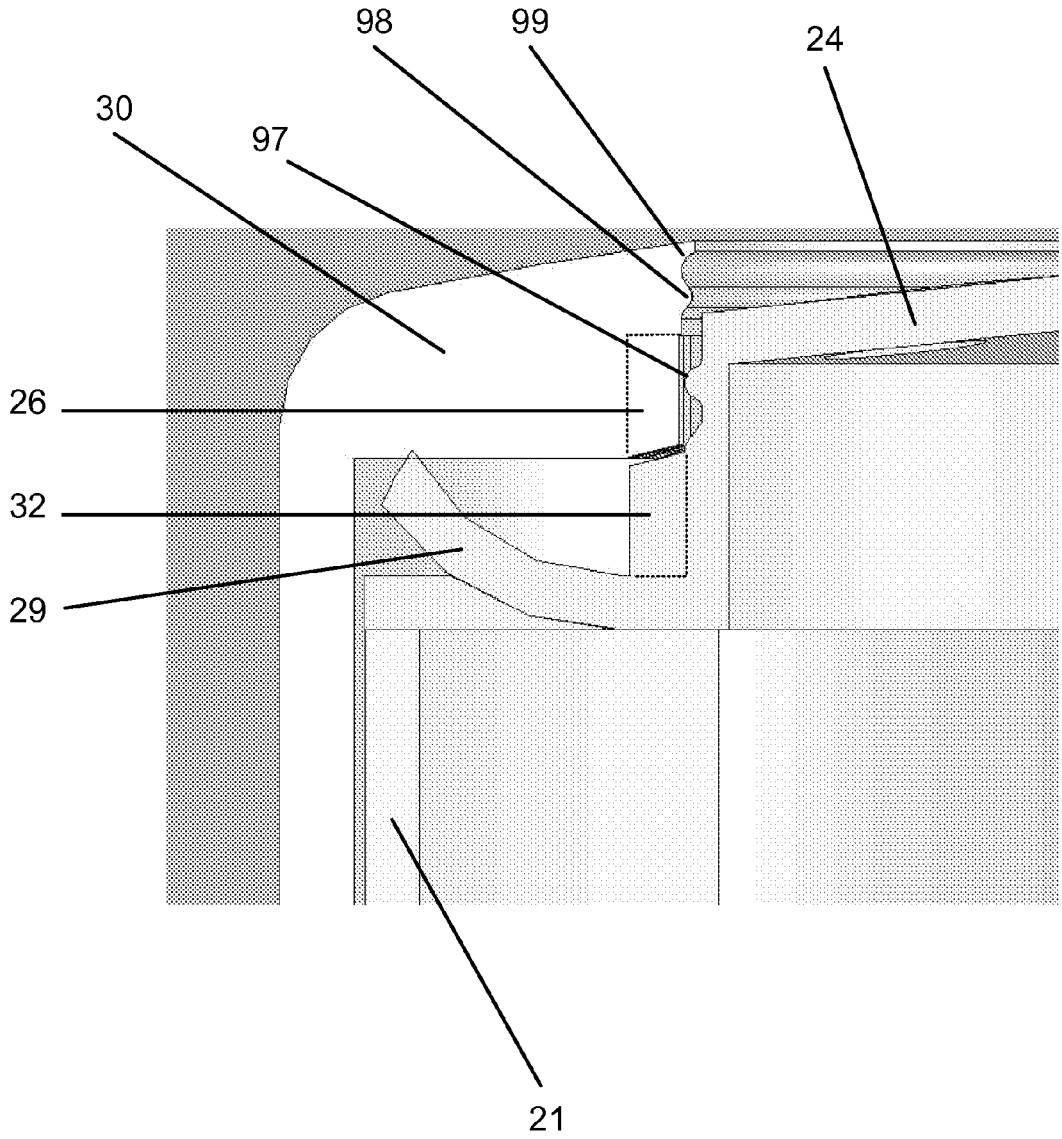
FIG. 7 shows a close-up sectional view of one form of childproofing mechanism in accordance with an embodiment of the present invention, in childproof mode.
Figure 8:
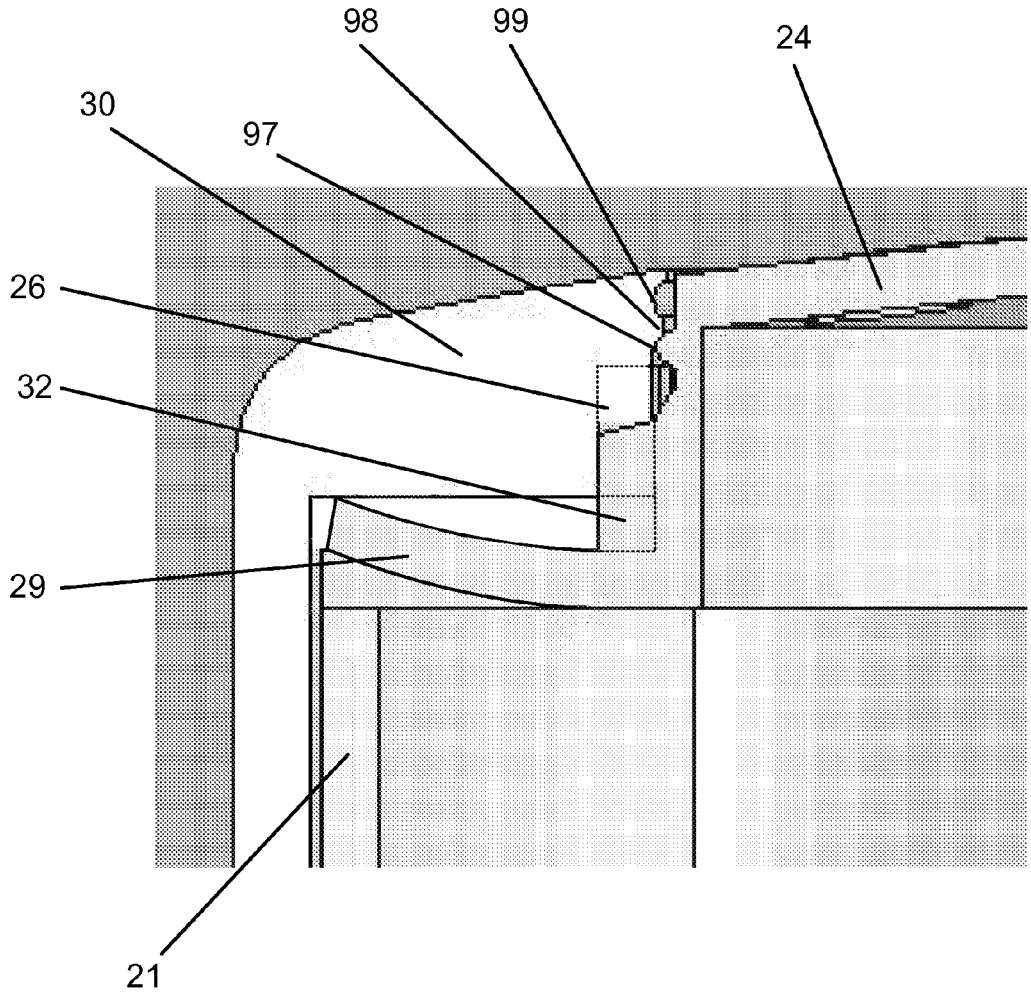
FIG. 8 shows a close-up sectional view of the childproofing mechanism of FIG. 7, in childproof mode with the splines of cap top insert and the cap exterior housing engaged.
Figure 9:
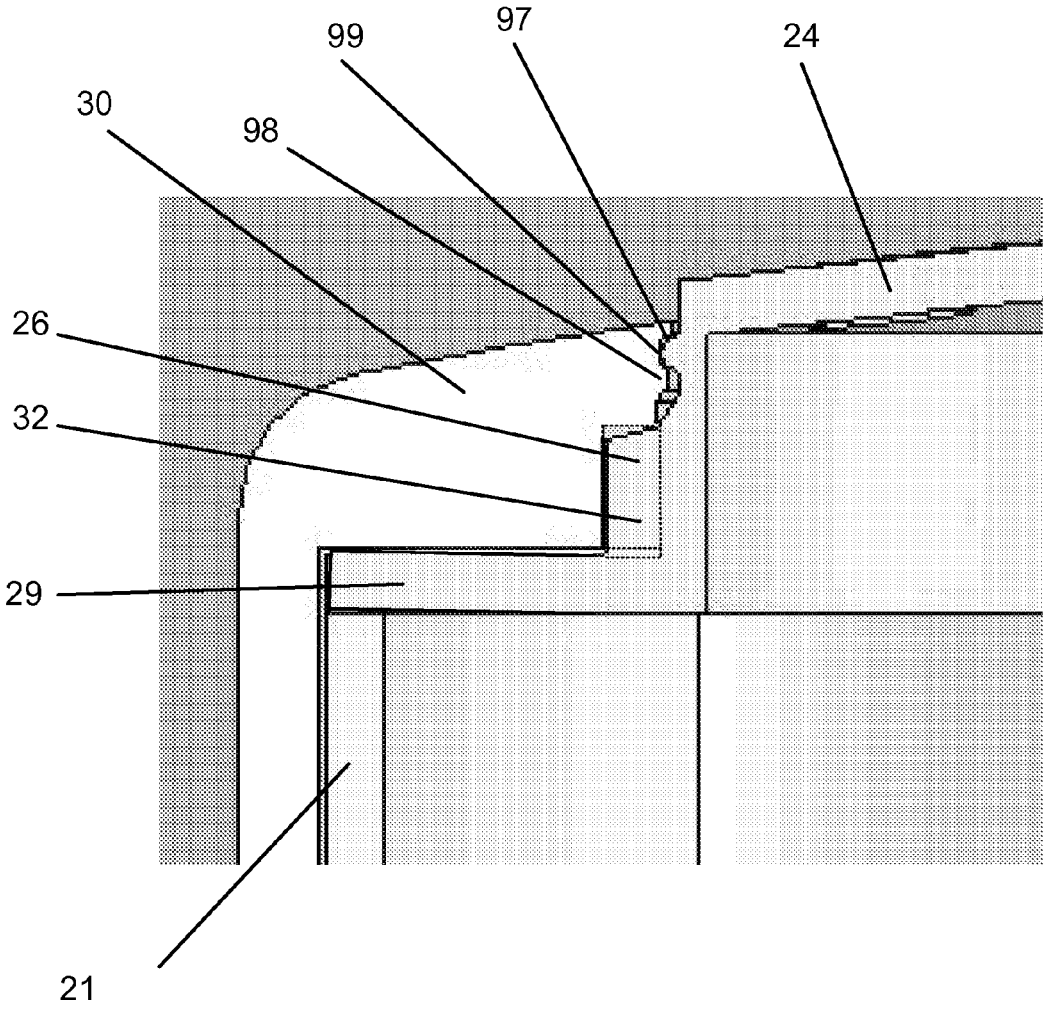
FIG. 9 shows a close up section view of the childproofing mechanism of FIG. 7, in non-childproof mode.
Figure 10:
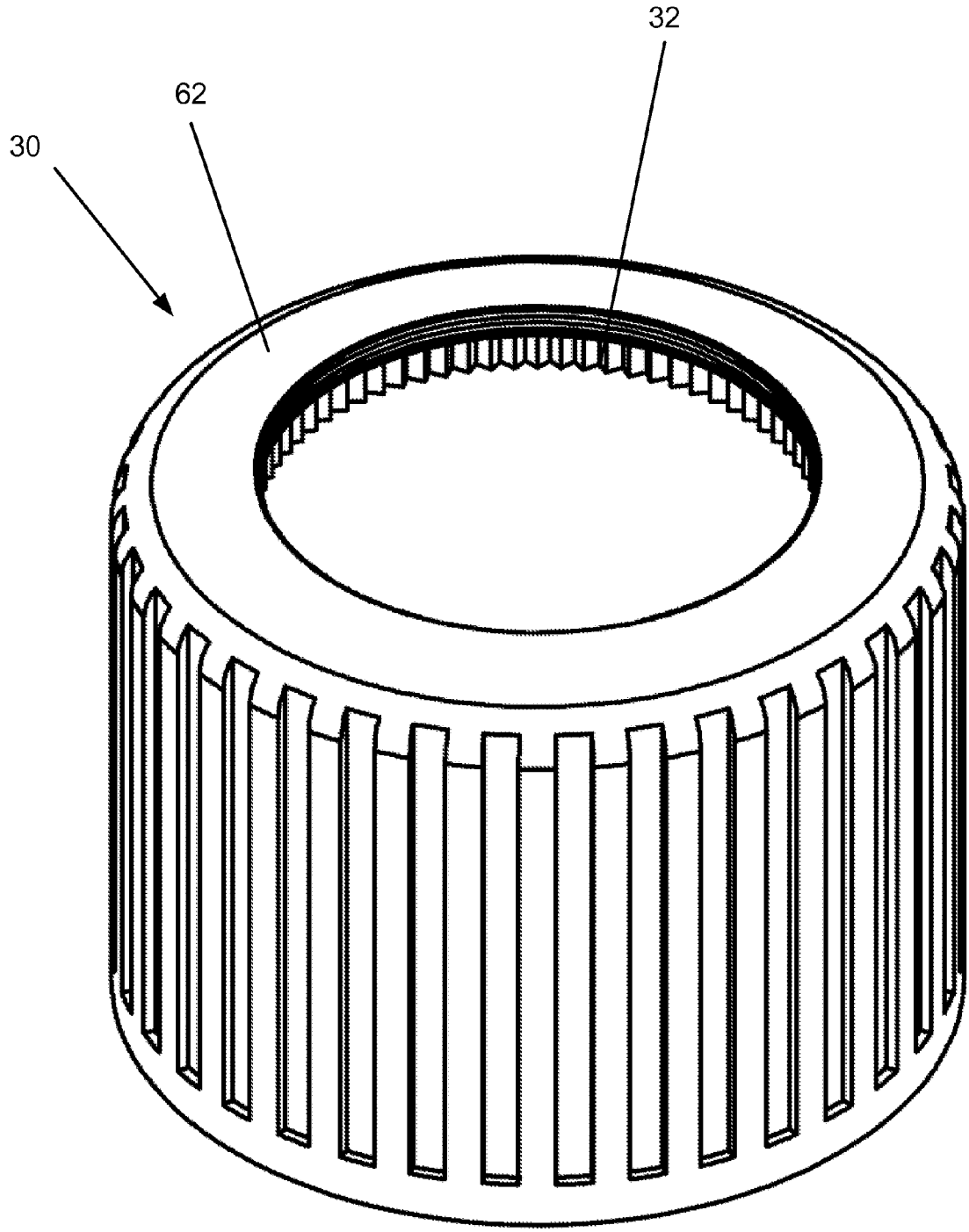
FIG. 10 shows a perspective view of the cap exterior housing in accordance with an embodiment of the present invention.
Figure 11:
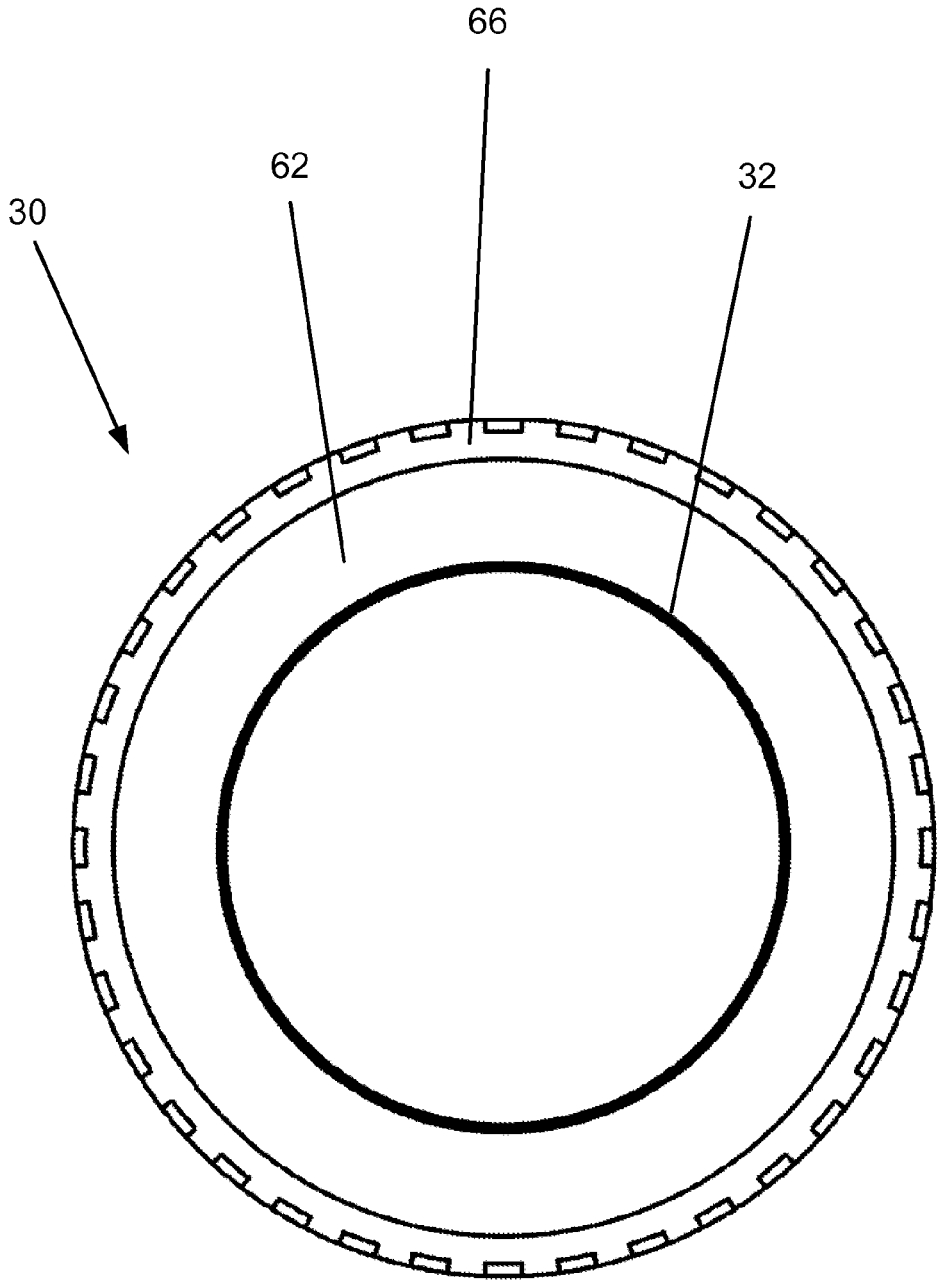
FIG. 11 shows a top view of the cap exterior housing of FIG. 10.
Figure 12:
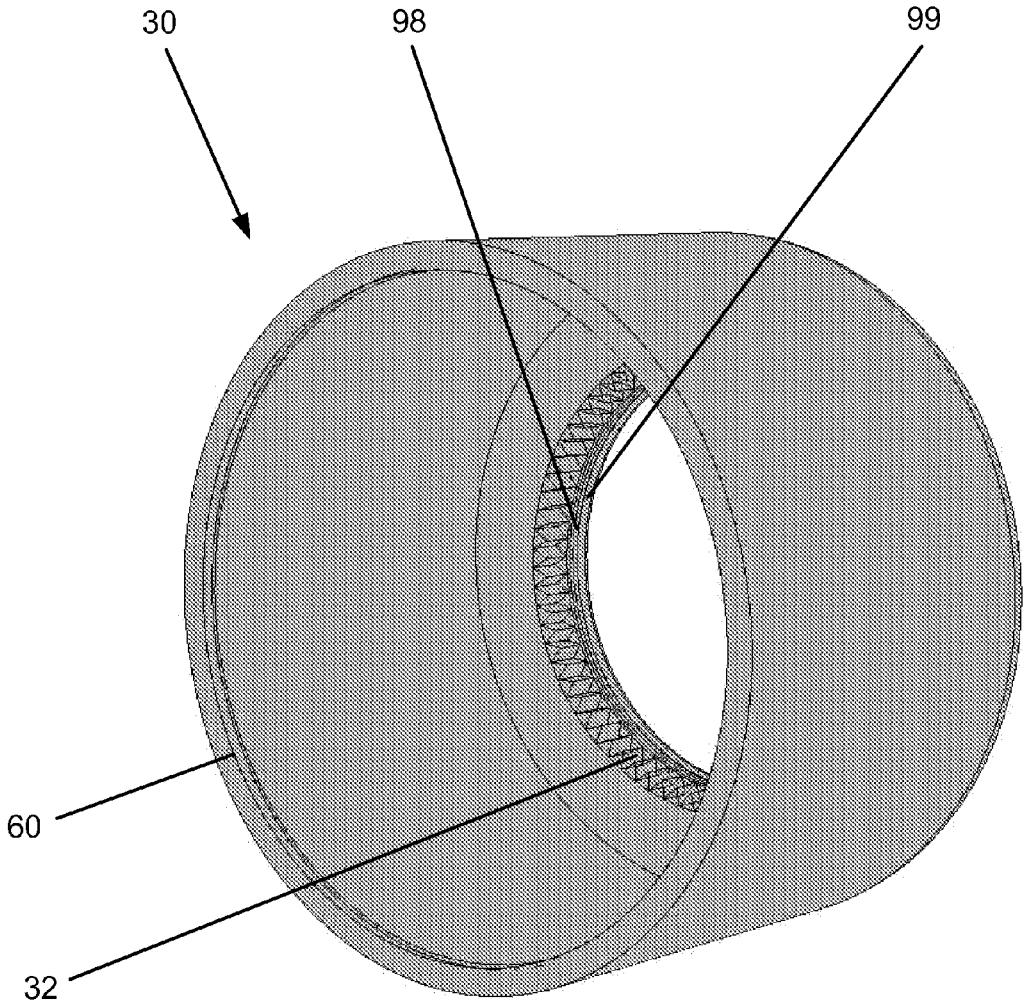
FIG. 12 shows a perspective view of the bottom and interior of the cap exterior housing of FIG. 10.

In an alternative exemplary embodiment, as shown in FIGS. 7 and 8, a rounded protrusion 97 is located on the outside of the raised central disk section 24 above the top of the splines 26, in the approximate place of the circumferential groove 27. A matching protrusion 98 and groove 99 is located on the inside rim of the cap top insert 20 above the cap top splines 32. The protrusions 97, 98 are of sufficient size so that they come into contact and cannot pass each other (i.e., the cap exterior housing protrusion 98 remains above the central disk protrusion 97) unless sufficient downward pressure is applied to the cap exterior housing 30. The protrusions 97, 98 also are located a sufficient distance apart and placed so that the splines 32 of the cap exterior housing 30 can engage the matching cap top insert splines 26 while the central disk protrusion 97 remains below the cap exterior housing protrusion 98. When used with the spring tabs 29 as described above, the cap used in this way functions in childproof mode, as seen in FIG. 8, as downward pressure is required to cause the splines 26, 32 to engage and enable the cap to be turned and removed. With additional downward pressure, the cap exterior housing protrusion 98 may be forced over and below the central disk protrusion 97, which becomes engaged with the groove 99. This causes the splines 26, 32 to remain engaged and the cap thus to function in non-childproof mode, as seen in FIG. 9. The cap may be returned to childproof mode by forcing the cap exterior housing protrusion 98 up and over the central disk protrusion 97.

In yet another alternative exemplary embodiment, one or more small tabs or protrusions may be located in the spaces between two or more of the splines 26 of the cap top insert 20. The protrusions are located at a sufficient distance below the top of the cap top insert splines 26 so that the matching splines 32 of the cap exterior housing 30 can engage the cap top insert splines 26 without passing over the protrusions. When used with the spring tabs 29 as described above, the cap used in this way functions in childproof mode. However, with sufficient downward pressure on the cap exterior housing 30, the splines 32 of the cap exterior housing 30 may be forced down and over the protrusions, causing the splines 26, 32 to remain engaged and the cap thus to function in non-childproof mode. The cap may be returned to childproof mode by forcing the splines 32 of the cap exterior housing 30 up and over the protrusions.

A plurality of flanges 21 extend downward from the outer circumference of the flat circular disk section 22 of the cap top insert 20. In one exemplary embodiment, as shown in F*igure* 2, there are four flanges 21, with two pairs of flanges 21 on opposite sides. An inwardly-extending ridge 31 is located along the inside bottom edge of each flange 21. The ridges 31 engage a matching groove 43 around the top of the threaded insert section 40 of the cap to secure the cap top insert 20 to the threaded insert section 40. The flanges 21 exert sufficient force to cause the cap top insert 20 and the threaded insert section 40 to rotate together during normal operation of the cap. In another exemplary embodiment, the matching grooves 43 extend only partway around the threaded insert section 40 to match the width and possibly the number of the flanges 21. This arrangement helps ensure that the cap top insert 20 and threaded insert section 40 rotate together during normal operation of the cap.

As seen in FIGS. 13-15 and 17, the threaded insert section 40 is cylindrical with a diameter substantially equal to the diameter of the cap top insert 20. The bottom end of the threaded insert 40 is open. The interior of the bottom end of the threaded insert 40 contains engaging means such as threads 41 that engage matching threads around the top of the medicine bottle. A flat sealing disk 42 is located inside of the threaded insert 40 above the top of the threads 41. The diameter of the sealing disk 42 is fractionally smaller than the interior diameter of the threaded insert 40, and provides a sealing contact with the top of the medicine bottle when the cap and bottle are closed.

The top end of the threaded insert 40 comprises a flexible diaphragm 44 extending down and into the threaded insert 40. The bottom center of the diaphragm 44 contacts the center of the sealing disk 42, helping to hold the sealing disk 42 in contact with the top of the medicine bottle when the cap and bottle are closed.

A rod or post 45 is located in the center of the diaphragm 44, and extends up to the circuit board 12. The rod 45 may be integrated with the diaphragm 44, and be molded as a part thereof. If non-conductive material, the rod 45 pushes a contact switch in the circuit board 12. The rod 45 may be capped in whole or in part with metal, in which case the rod 45 comes into contact with two contact points in the circuit board 12. The rod 45 may also be a separate piece attached to the center of the diaphragm 44 by attachment means. In one exemplary embodiment, the rod 45 itself is made of metal or a conductive material, and may be attached to the diaphragm 44 by any suitable means, such as hole or socket molded in the diaphragm 44 to receive an end of the rod 45.

Figure 2A:
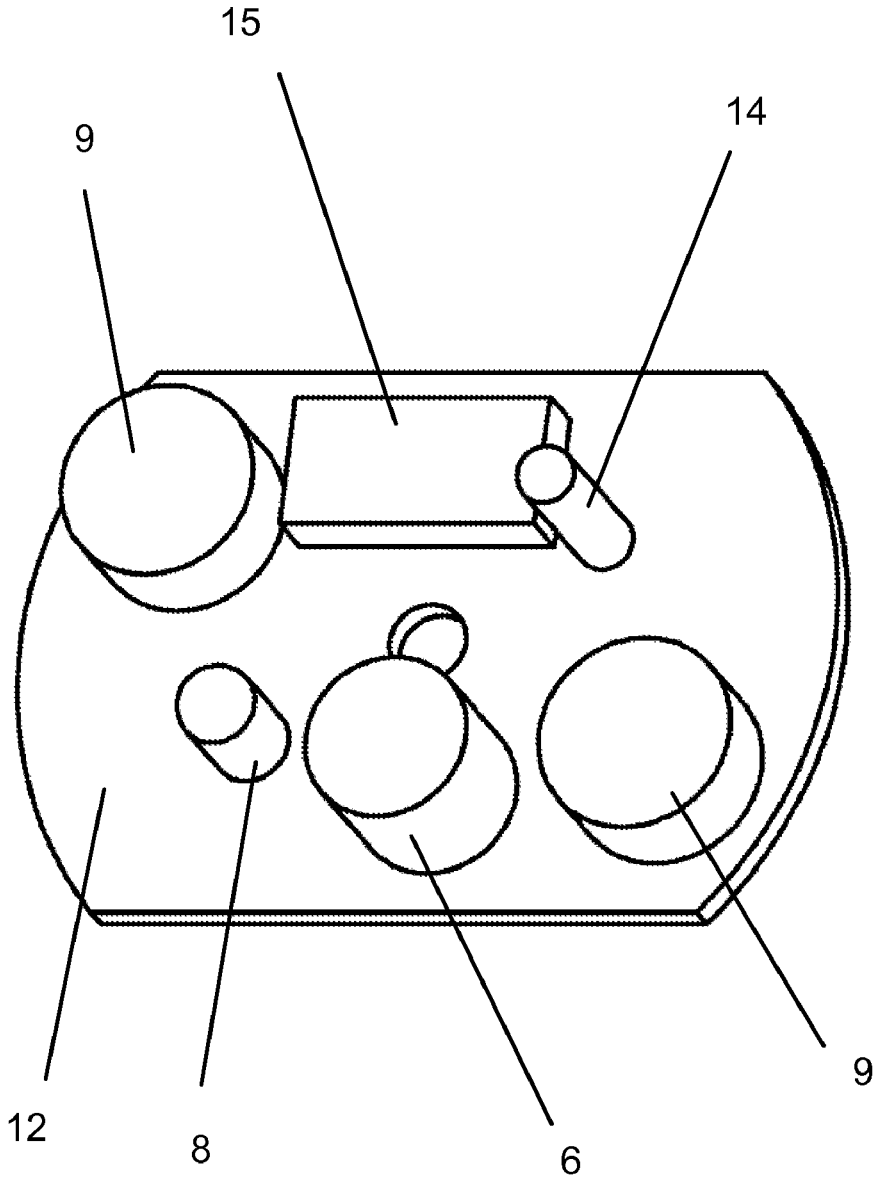
FIG. 2*a* shows a perspective view of an alternative configuration of a circuit board and timer in accordance with another embodiment of the present invention.
Figure 2B:
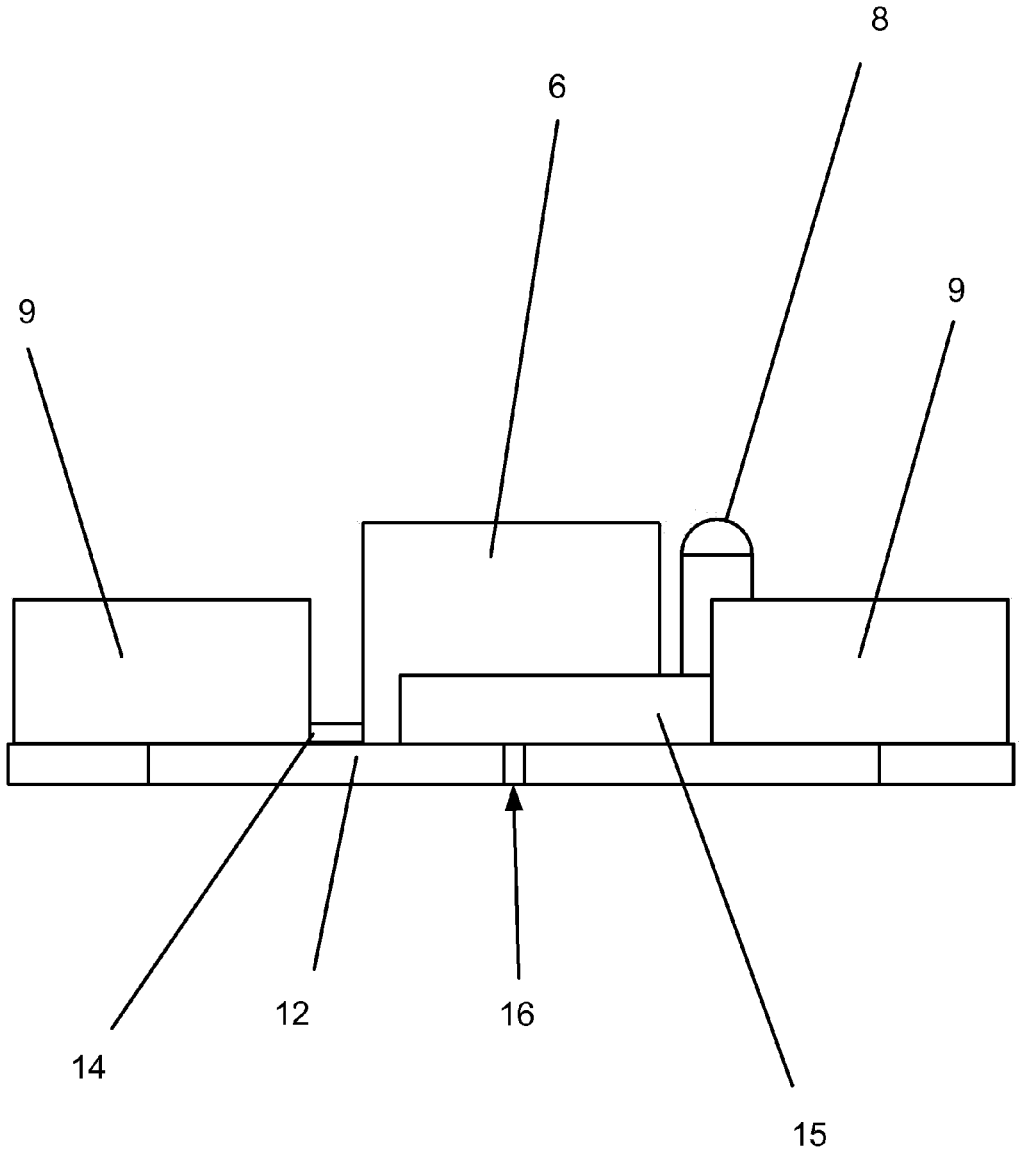
FIG. 2*b* shows a side view of the circuit board and timer of FIG. 2*a*.
Figure 3A:
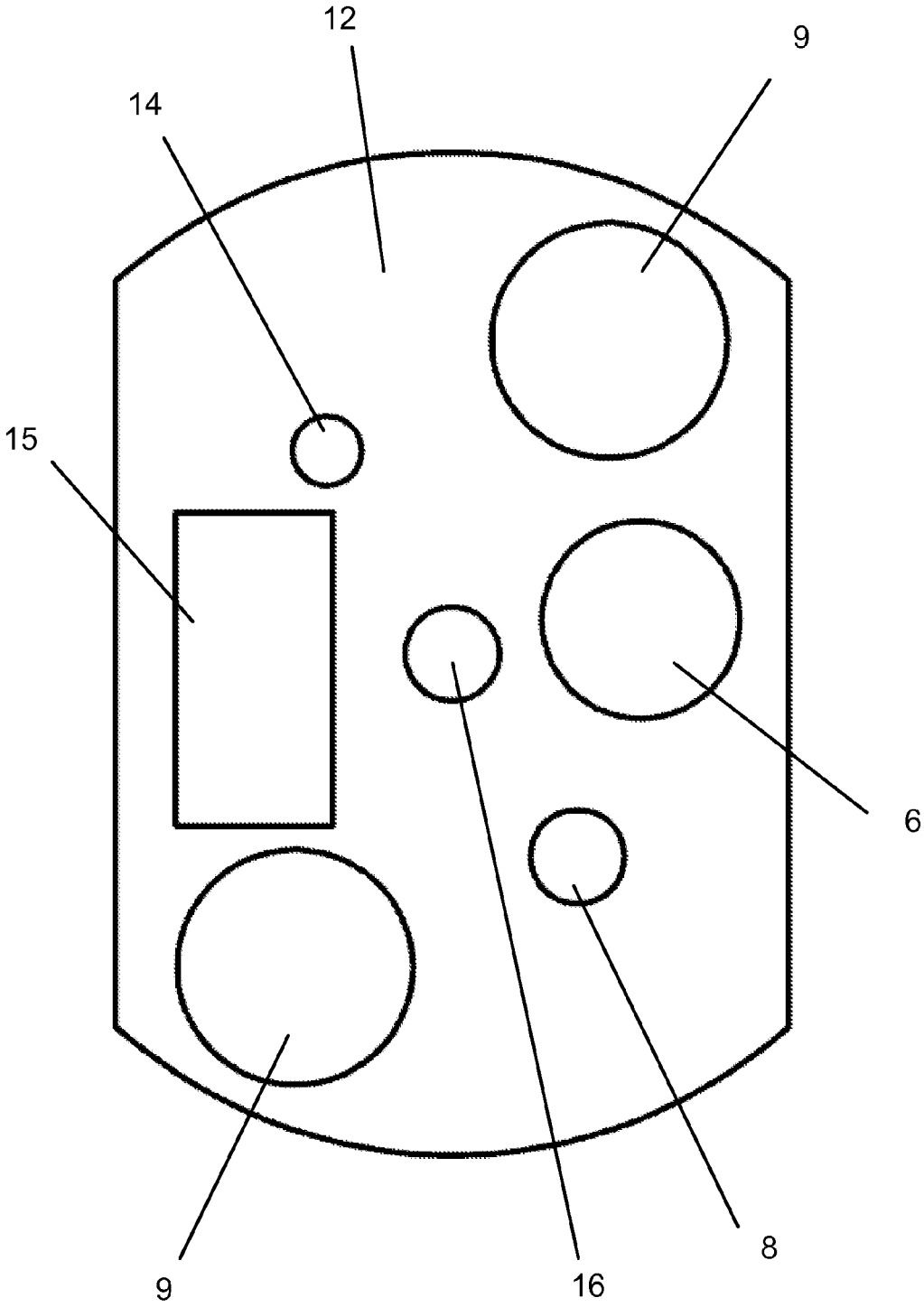
FIG. 3*a* shows a top view of the circuit board and timer of FIG. 2*a*.
Figure 16:
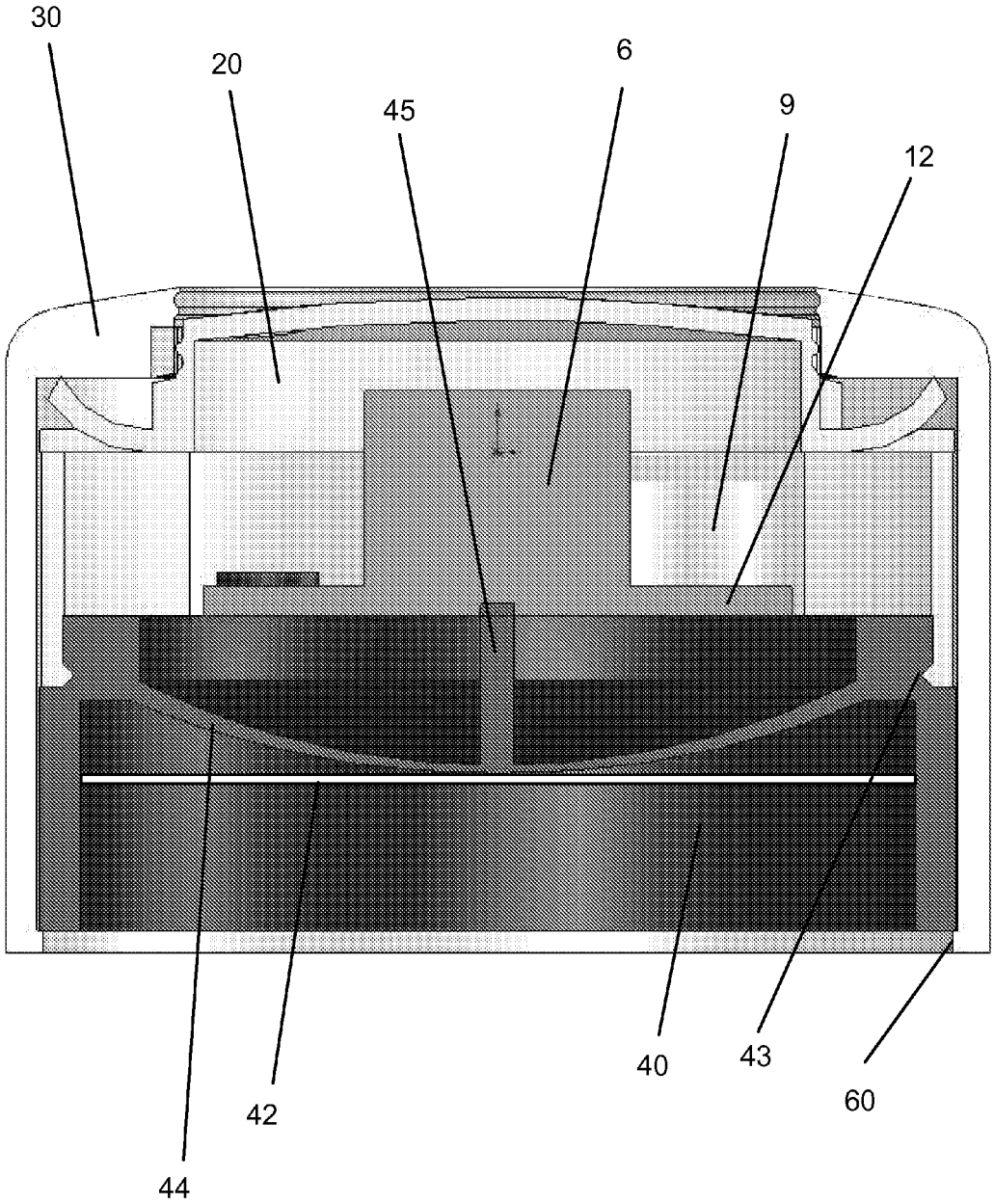
FIG. 16 shows a cross-section of an assembled unit in accordance with an embodiment of the present invention.
Figure 17:
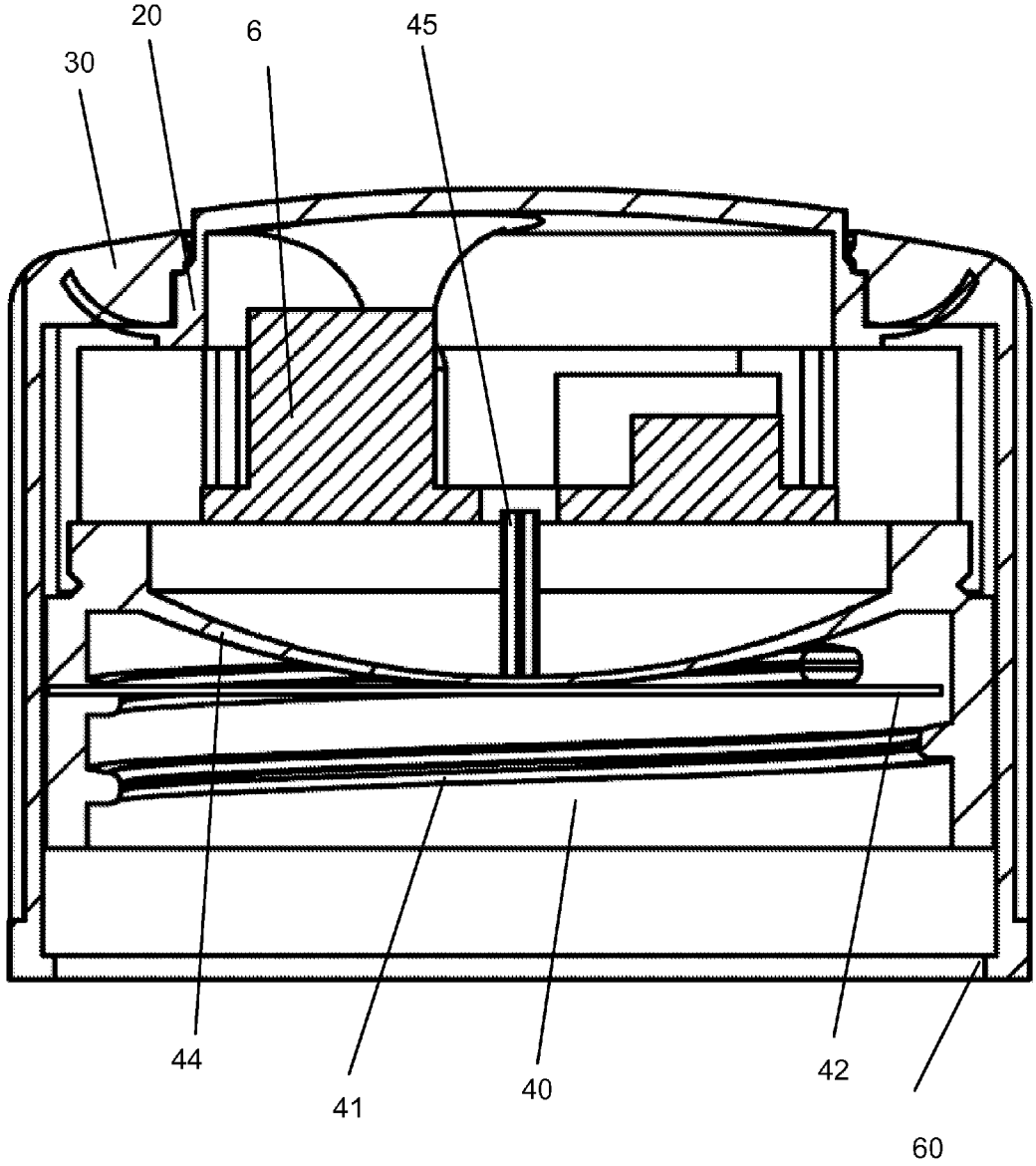
FIG. 17 shows a cross-section of an assembled unit in accordance with another embodiment of the present invention.

When the cap is fastened on the top of the bottle, such as when being stored, for example, the diaphragm 44 is pushed up, thereby pushing up the rod or post 45 through the central hole 16 in the circuit board 12, as seen in FIG. 16, to push a contact switch or come into contact with two contact points, as described above. While in this mode, the batteries are supplying power to the circuit and the timer is counting down to the appropriate time for the next dosage of medicine. In one alternative embodiment, as seen in FIGS. 2*a*, 2*b*, and 3*a*, the rod or post 45 pushes up a rectangular or plate-like switch 15 on one side so that it is no longer touches a contact switch or contact points on the circuit board 12. In another embodiment, as described above, the rod or post 45 is made of, or is capped or coated with, metal or a conductive material, and comes into contact with two contact points on the circuit board 12. When the appropriate time has elapsed, an alert signal(s) is given. As disclosed above, alerts can be visible, audible, or both. The patient or user then removes the cap, which releases the pressure on the diaphragm 44 from the bottle, which in turn causes the rod 45 to move down and away from contact with the timing circuit 6. This resets the timer. In the one alternative embodiment described above, this may be accomplished when the switch 15 moves down and touches the contact on the circuit board 12 in response to the rod 45 movement. The end of the switch 15 away from the hole 16 may be affixed to the circuit board 12 in a variety of ways, leaving the end above the hole 16, in whole or in part, free to move up and down in response to movement of the rod or post 45. In the other alternative embodiment, this is accomplished when the rod 45 moves out of contact with the contact points.

Figure 13:
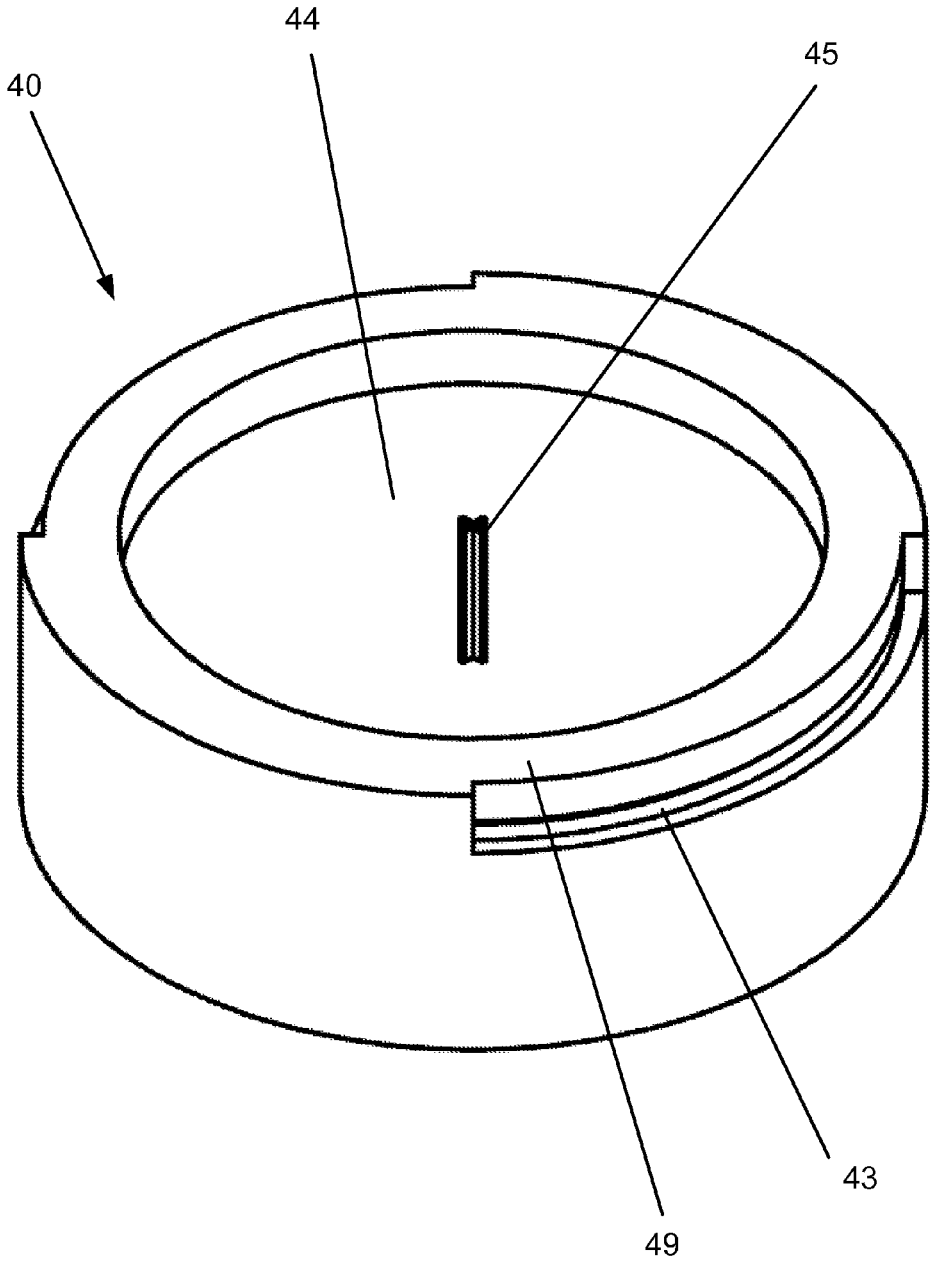
FIG. 13 shows a perspective view of the threaded insert section in accordance with an embodiment of the present invention.
Figure 14:
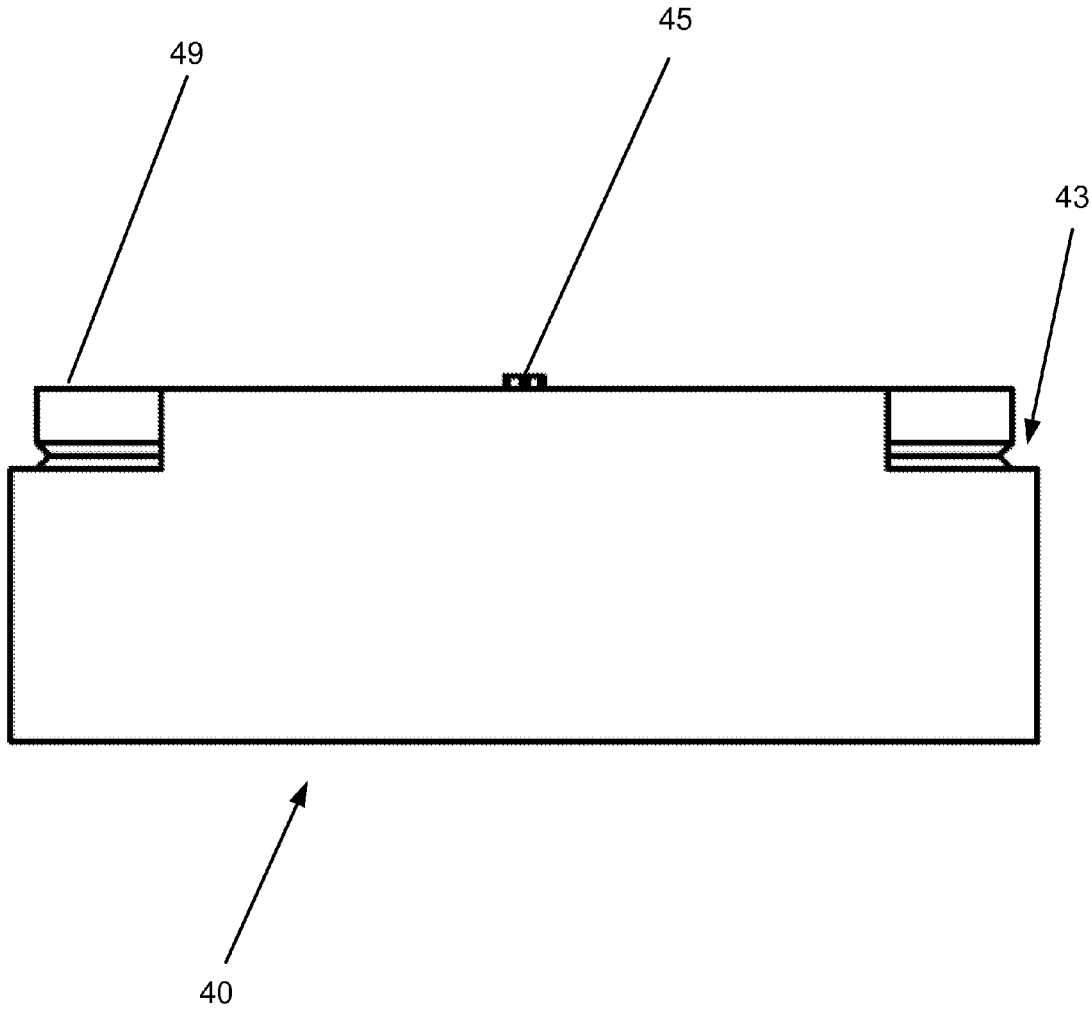
FIG. 14 shows a side view of the threaded insert section of FIG. 13.
Figure 15:
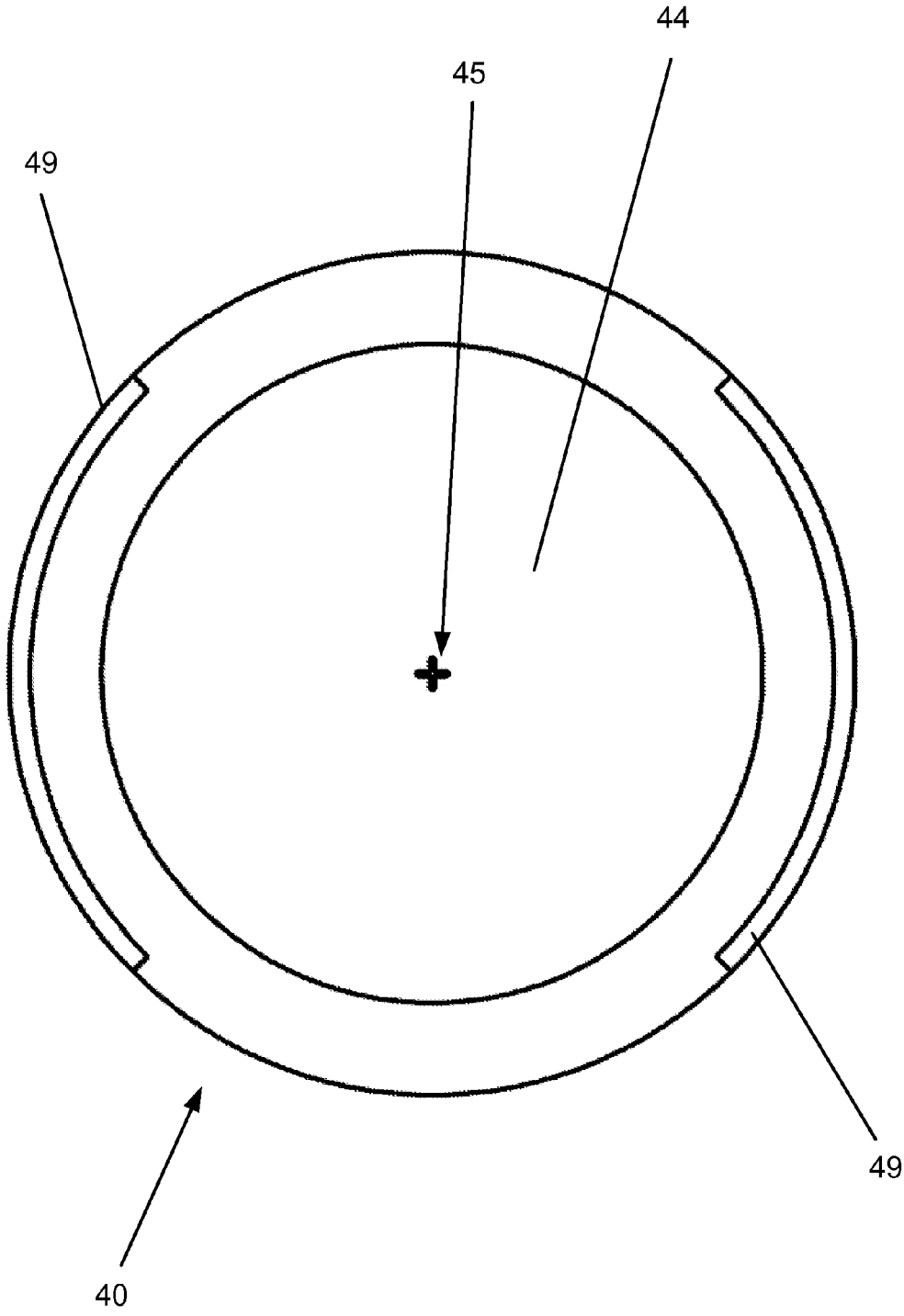
FIG. 15 shows a top view of the threaded insert section of FIG. 13.

In one exemplary embodiment, the top end of the threaded insert 40 comprises one or more inset sections 49 of smaller diameter than the threaded insert 40. The outer part of these sections 49 contain a groove 43 used to secure the cap top insert 20 by means of the flanges 21. In one exemplary emobodiment, as seen in FIG. 13, the grooves 43 extend only partway around the circumference of the threaded insert section 40 to match the width and possibly the number of the flanges 21. FIG. 13 shows an arrangement where two grooves 43 are located on opposite sides of the threaded insert section 40, each groove 43 sized to engage two adjacent flanges 21. This arrangement helps ensure that the cap top insert 20 and threaded insert section 40 rotate together during normal operation of the cap.

As seen in FIGS. 10-12 and 18 the cap exterior housing 30 is cylindrical. In one exemplary embodiment, the outside of the housing 30 may be ridged or grooved 31 to facilitate a better grip by the user. The interior diameter of the cap exterior housing 30 is slightly larger than the exterior diameter of the top insert 20 and the threaded insert 40, so that the top insert 20 and threaded insert 40 fit snugly within the cap exterior housing 30, but can move freely therein. In one exemplary embodiment, the interior of the bottom end of the cap exterior extends slightly inward to provide a shallow lip 60 to hold the threaded insert 40 inside the cap exterior housing 30 once inserted.

The top end of the cap exterior housing 30 has a section 62 extending substantially inward, which assists in retaining the cap top insert. The interior diameter of the rim-like section of the top end 62 is slightly larger than the diameter of the raised central disk section 24, so the raised central disk section 24 can extend up and through the open center of the top end. The cap exterior housing splines 32 that engage the matching splines 26 around the raised central disk section 24 are located on the underside of the rim-like section of the top end, along the inside edge. In an exemplary embodiment, the outermost edge 66 of the top end is raised for more convenient operation by the user.

In one exemplary embodiment, the present invention may be quickly and easily assembled at the factory or other workplace with minimal effort and a low failure rate. A typical assembly may consist of the following steps: the circuit board (including batteries with tabs, if any) is fastened to the cap top insert; the threaded insert is fastened to the cap top insert below the circuit board; the sealing disk is inserted into the threaded insert; and the resulting unit is inserted into the cap top housing. These steps may be in a different order in whole or in part; for example, the sealing disk may be inserted into the threaded insert after the unit comprising the circuit board, cap top insert, and threaded insert is inserted into the cap top housing. In an embodiment where a snap ring is used, the snap ring is then placed on the circumferential groove on the cap top insert. The assembled unit may then be shipped. In configurations where power is constantly supplied, the microprocessor chip can be placed in sleep mode in order to conserve power. This also allows the assembled unit to be tested at the factory or during shipping. A standby or low power mode also may be available.

In another exemplary embodiment, the first operation of the assembled unit, which typically is stored separately from the medicine bottle, proceeds as follows: the medicine bottle is filled with the appropriate amount of medicine; the battery tabs, if any, on the assembled unit are removed; the assembled unit is fastened onto the bottle, causing the rod on the diaphragm to be pushed up and into contact with the timing circuit; and the timing apparatus is in operational mode and ready for the time or time period to be set.

In one exemplary embodiment, setting the time period may be accomplished by holding down the reset button or switch for a certain period of time (e.g., 3 seconds), pressing the reset button or switch a certain number of times in succession, or a combination of the above. A sound or visual signal can be provided to indicate when the setting operation has been successful.

Typical time periods include, but are not limited to, once per day, twice per day, three times per day, and four times per day. The exact number of hours in each period may vary in accordance with accepted medical practice to encompass sleep periods and the like. In configurations where power is constantly supplied to the microprocessor or timing circuitry 6, and actual time can be stored in memory, these time periods can all be established for particular times, and not calculated relative to the last reset or cap removal. Thus, in one embodiment, a variation in the time when one dose of medicine is taken, or even the missing of a dose, will not vary the time when the next dose of medicine should be taken.

In another embodiment, the microprocessor or timing circuitry 6 may apply simple logic to determine whether the act of opening the bottle was intentional. For example, if the cap was removed before less than half of the set time period has expired since the last valid removal, the device assumes that the removal was a mistake, and does not reset (i.e., it will still give an alert at the end of the time period). If the cap is removed when at least half of the set time period has expired, however, the device assumes that the removal was intentional and that the dose of medicine scheduled to be taken at that end of that time period has been taken. The device then resets. Thus, for example, if the time period is 24 hours, removal of the cap within the first 12 hours of the time period will not cause a reset, but removal of the cap between 12 and 24 hours will cause a reset. In another exemplary embodiment, a sound or visual signal can acknowledge the removal and replacement of the cap on the bottle, and indicate that the timer has been reset for the next time period. This configuration is especially useful in conjunction with the above method of determining whether the removal of the cap was intended for the purpose of taking a dose of medicine.

The use of the microprocessor allows great flexibility with regard to customizing various aspects of the present invention. Customization may be done by the supplier, drug store, pharmacist, physician, or patent.

In yet another embodiment, the device may presume that enough medicine is being supplied for only a certain time period, and give a warning or alert when that time period is about to expire to remind the patient to get the prescription refilled. The device would then stop operating a few days or so after the expiration of that time period. For example, if the prescription is refilled on a monthly basis, the device can beep or flash continuously or on an intermittent basis after 27 days to remind the patient to get the prescription refilled. And the device would stop operating after 33 days.

Thus, it should be understood that the embodiments and examples have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art. Accordingly, it is intended that the scope of the invention be defined by the claims appended hereto.

I claim:

1. A medicine container timing apparatus, comprising:

a container cap with a top end and an open end;

electronic timing means, said electronic timing means disposed within the cap and progressively tracking the time when activated;

a diaphragm disposed within the container cap, said diaphragm having a rod extending generally perpendicular from at or near the center of the diaphragm, wherein said rod is pushed into contact with the electronic timing means and activates said timing means when the container cap is placed on a container; and a sealing disk disposed within the container cap between the diaphragm and the open end of the container cap, wherein said sealing disk is adapted to push the diaphragm and rod towards the top end of the container cap when the container cap is placed on a container.

2. The apparatus of claim 1, further wherein the electronic timing means is disposed between the top end of the container cap and the diaphragm, and the diaphragm forms a bowl with a convex and concave side, the concave side facing the electronic timing means, and with the rod extending from the center of the concave side.

3. The apparatus of claim 1, further comprising at least one battery disposed within or adjacent to the electronic timing means.

4. The apparatus of claim 1, further wherein the top end of the container cap has one or more apertures therethrough.

5. A medicine container timing cap, comprising:

a cap top housing having an open end, a generally circular top end with a circular aperture therethrough with an interior edge, and a sidewall extending circumferentially around the generally circular top end, the cap top housing sidewall having an interior surface and an exterior surface;

a cap top insert housed within the cap top housing, said cap top insert having a generally circular end with a raised center portion with a top side and a vertical sidewall adapted to fit into or through the circular aperture of the cap top housing, and one or more sidewall flanges extending circumferentially around the generally circular end of the cap top insert;

electronic timing means for measuring elapsed time when activated; and a second insert housed with the cap top housing, said second insert having a generally circular top end with a sidewall extending circumferentially around the generally circular top end, the second insert sidewall having an interior surface and an exterior surface, the generally circular top end comprising a flexible diaphragm with a concave side and a convex side, the convex side extending down and into the second insert, the concave side having a rod extending upward generally perpendicular from at or near the center of the diaphragm, wherein said rod is pushed into contact with the electronic timing means and activates said electronic timing means when the cap is placed on a container.

6. The cap of claim 5, further comprising a sealing disk housed with the cap top housing between the diaphragm and the open end of the cap top housing, wherein said sealing disk is adapted to push the diaphragm and rod towards the electronic timing means when the cap is placed on a container.

7. The cap of claim 5, further comprising at least one battery disposed within or adjacent to the electronic timing means.

8. The cap of claim 5, further comprising display means for displaying information from the electronic timing means.

9. The cap of claim 5, further comprising control means for controlling the electronic timing means.

10. The cap of claim 5, further comprising audible or visual alarm means, or both.

11. The cap of claim 5, wherein the rod is metal or a conductive material in whole or in part.

12. The cap of claim 5, wherein the top side of the raised center portion of the cap top insert has one or more apertures.

13. The cap of claim 5, further wherein at least a portion of the sidewall of the raised center portion of the cap top insert has a plurality of splines adapted to engage matching splines located on at least a portion of the interior edge of the circular aperture of the cap top housing.

14. The cap of claim 13, wherein the cap top housing can be moved longitudinally relative to the cap top insert so that the splines of the raised center and the interior edge can be selectively engaged and disengaged.

15. The cap of claim 14, wherein the cap can be removed from a container only when the splines are engaged.

16. The cap of claim 13, wherein the cap cannot be removed from a container unless the splines are engaged.

17. The cap of claim 14, further comprising means to press the cap top housing away from the cap top insert so that the splines cannot be engaged absent the application of sufficient pressure.

18. The cap of claim 17, further wherein said pressing means comprises one or more spring tabs located on top of the cap top insert.

19. The cap of claim 14, further comprising a retaining ring adapted to engage a circumferential groove located in the sidewall of the raised center portion of the cap top insert, wherein the splines are constantly engaged when the retaining ring is in place.

20. The cap of claim 14, further comprising arounded protrusion extending from the sidewall of the raised center portion of the cap top insert, adapted to engage a matching groove located above a protrusion located on the interior edge of the circular aperture of the cap top housing.

21. The cap of claim 5, further comprising one or more inwardly-extending ridges located along the inside bottom edge of the sidewall flanges, said ridges adapated to engage a matching groove located on the exterior sidewall of the second insert to secure the cap top insert to the second insert.

22. The cap of claim 21, further wherein the interior sidewall of the second insert has means to engage the top of a container.

23. The cap of claim 22, further wherein said engaging means comprise a plurality of threads.

* * * * *